US006405619B1

(12) United States Patent
Lamond et al.

(10) Patent No.: US 6,405,619 B1
(45) Date of Patent: Jun. 18, 2002

(54) SELF-SECURING TOOL HANDLE

(75) Inventors: Donald R. Lamond, Haworth; David Schiff, Highland Park; Adam Sanchez, Nutley, all of NJ (US); Richard Whitehall, New York, NY (US)

(73) Assignee: WKI Holding Company, Inc., Elmira, NY (US)

( * ) Notice: Subject to any disclaimer, the term of this patent is extended or adjusted under 35 U.S.C. 154(b) by 0 days.

(21) Appl. No.: 09/815,690

(22) Filed: Mar. 23, 2001

(51) Int. Cl.[7] ..... B25G 1/00
(52) U.S. Cl. ..... 81/177.1; 81/489; 16/110.1
(58) Field of Search ..... 81/177.1, 489; 16/110.1, 111.1

(56) References Cited

U.S. PATENT DOCUMENTS

| | | | | |
|---|---|---|---|---|
| D42,622 | S | | 6/1912 | Gafinowitz |
| D47,435 | S | | 6/1915 | Petersen |
| D49,458 | S | | 8/1916 | Richard, Jr. |
| 1,405,432 | A | * | 2/1922 | Peterson ..... 81/177.1 |
| D94,697 | S | | 2/1935 | Krause |
| D96,002 | S | | 6/1935 | Amrine |
| 2,100,034 | A | | 11/1937 | Leonard |
| D193,202 | S | | 7/1962 | Eckersberg |
| D198,197 | S | | 5/1964 | Utz |
| 3,173,462 | A | * | 3/1965 | Koeppel ..... 81/177.1 |
| 3,263,534 | A | | 8/1966 | Webbeking |
| D222,872 | S | | 1/1972 | Boucher |
| 3,955,451 | A | * | 5/1976 | Lohness ..... 81/177.1 |
| D241,604 | S | | 9/1976 | Ward |
| 4,106,372 | A | | 8/1978 | Miller |
| 4,409,866 | A | * | 10/1983 | McBride ..... 81/177.2 |
| 4,454,791 | A | | 6/1984 | Seward, III |
| 4,653,357 | A | | 3/1987 | Carlmark |
| 4,709,602 | A | * | 12/1987 | Grabovac et al. ..... 81/177.1 |
| 4,735,121 | A | | 4/1988 | Coulson |
| 4,942,791 | A | * | 7/1990 | Stewart et al. ..... 81/177.1 |
| 4,969,231 | A | * | 11/1990 | Mader et al. ..... 81/177.1 |
| 5,003,849 | A | * | 4/1991 | Lawrie ..... 81/177.75 |
| D318,602 | S | | 7/1991 | Vosbikian |
| 5,375,490 | A | | 12/1994 | Carlmark |
| D375,035 | S | | 10/1996 | Mangol |
| 5,659,959 | A | * | 8/1997 | Parlowski ..... 16/110 R |
| 5,730,231 | A | * | 3/1998 | Racodon ..... 81/489 |
| 5,740,586 | A | | 4/1998 | Gomas |
| 5,791,055 | A | | 8/1998 | Mangol |
| 5,819,594 | A | * | 10/1998 | Sjovall ..... 81/489 |
| 5,911,798 | A | * | 6/1999 | Arnold ..... 81/177.1 |
| 6,089,130 | A | * | 7/2000 | Wu ..... 81/177.1 |
| 6,125,725 | A | | 10/2000 | Fox et al. |

* cited by examiner

*Primary Examiner*—James G. Smith
*Assistant Examiner*—Hadi Shakeri
(74) *Attorney, Agent, or Firm*—Burr & Brown

(57) ABSTRACT

A self-securing handle for a tool having a longitudinally extending main body portion, is provided. The handle includes an elongate body having a first end and a longitudinally opposed second end, and a central cavity extending from the first end to the second end thereof. The handle further includes a securing mechanism positioned within the central cavity proximate the second end of the handle. The handle receives the tool main body portion within the central cavity, and the securing mechanism mates with a receiving structure on the tool main body portion to secure the handle to the tool main body portion.

41 Claims, 4 Drawing Sheets

SELF-SECURING TOOL HANDLE

FIELD OF THE INVENTION

The present invention relates to a hand tool, such as a wrench, having a self-securing handle. The present invention, in particular, relates to a tool having a separately formed handle which is assembled over and self-secured to the tool without additional fasteners or adhesives.

BACKGROUND OF THE INVENTION

Recently, many tool manufacturers have added ergonomic or coated handles atop metal tools, such as wrenches, to improve the grip and tactile feel of the tool during use. Normally, the metal tool is inserted in a mold and one or more layers of a handle material are molded around the shaft of the tool. For example, U.S. Pat. No. 5,740,586 describes a technique of coating tool shafts with multiple layers of elastomeric materials by injection over-molding.

One problem with the known manufacturing techniques is flashing. The molds used in the over-molding process are precise, and the tool must fit precisely therein. It is difficult to mass produce tools, especially by forging, with the necessary degree of precision such that each tool will precisely fit into the mold. Because the molds will not accept varying shapes of forged tools, even minor variations in the cross-section of a tool can prevent sufficient mold contact, and coating materials are expelled from the mold at the open end through which the non-coated portion of the tool extends, and along any nonconforming portion of the tool shaft. This makes it nearly impossible to use a single mold to manufacture multiple forged tool handles without the presence of flashing that must be subsequently removed.

It is generally known to use inserts to compensate for tool variations and essentially plug the gaps that would allow flashing. These inserts, however, also need to be precisely manufactured to correct individual nonconforming fits, of which there may be a number of variations. This technique is not a desirable solution to the problem, because it adds an additional step in the manufacturing process and increases the overall production cost of the tool.

Even if the handle is molded apart from the tool shaft to avoid the flashing problem, another manufacturing step, such as riveting or applying an adhesive, is required to secure the handle firmly onto the tool shaft.

It would be desirable to provide a tool having a self-securing handle than can be formed separately from the tool and attached thereto in a single assembly step that does not necessitate using rivets, adhesives, and the like. This would eliminate the problems commonly experienced with over-molding handle material, decrease manufacturing costs, and increase the efficiency of the overall manufacturing process.

SUMMARY OF THE INVENTION

It is an object of the invention to overcome the drawbacks of the prior art, particularly to provide a separate, self-securing handle for a tool which is assembled over the tool in a single assembly step.

In accordance with one embodiment of the present invention, a self-securing handle for a tool having a longitudinally extending main body portion is provided. The self-securing handle includes an elongate body having a first end and a second end, and includes a central cavity passing therethrough from the first end to the second end. The self-securing handle further includes a securing mechanism located within the elongate body proximate the second end.

The self-securing handle receives the tool main body portion within the central cavity, and the securing mechanism mates with a receiving structure on the tool main body portion to secure the handle to the tool main body portion.

In accordance with a preferred embodiment, the self-securing handle further includes an inner core body having a first end proximate the first end of the handle, and a second end proximate the second end of the handle. The inner core body includes an inner surface which opposes the main body portion of the tool and an outer surface, and extends longitudinally from the first end toward the second end thereof. Further, the central cavity of the handle passes through the inner core body from the first end to the second end thereof. The self-securing handle also includes an external layer extending longitudinally from the first end of the handle toward the second end, and the external layer substantially covers an outer surface of the inner core body.

It is preferred that the inner core body is made of a hard grade elastomer material, more preferably a polypropylene material. It is also preferred that the external layer is made of a flexible grade elastomeric material, more preferably SANTOPRENE (a flexible elastomeric material).

In accordance with another preferred embodiment, the securing mechanism includes at least one, but more preferably two, securing tabs positioned within the central cavity on opposite sides thereof. The securing tabs extend radially into the central cavity and axially toward the second end of the handle. A stop member is also provided, positioned proximate the first end of the elongate body and located within the central cavity of the elongate body, for preventing axial movement of the handle along the main body portion of the tool in a direction toward the first end of the handle.

According to another embodiment of the present invention, a tool is provided including a tool head portion, and a tool main body portion having a first end and an opposed second end. The first end is connected to the tool head portion, and the tool main body portion extends longitudinally from the first end toward the second end. The tool main body portion further includes a receiving structure adjacent the second end thereof. A self-securing handle is also provided, including an elongate body having a first end and a second end, and having a central cavity passing therethrough from the first end to the second end, such that the tool main body is positioned within the central cavity. The self-securing handle further includes a securing mechanism within the elongate body proximate the second end, which mates with the receiving structure of the tool main body portion for securing the handle to the tool main body portion.

It is preferred that the cross-sectional shape of the tool main body portion substantially corresponds to the cross-sectional shape of the central cavity, and the crosssectional shape is substantially non-circular to prevent rotation of the handle about the longitudinal axis of the tool main body portion. It is also preferred that the tool includes a stepped portion on an outer surface of the tool main body portion and a corresponding stepped portion on an inner surface of the central cavity. These stepped portions prevent the handle, once in the locked position, from moving toward the first end of the tool main body portion.

According to another embodiment of the present invention, a method for assembling a self-securing handle on a tool is provided, and includes: providing a tool having a head portion and a longitudinally extending main body portion, the main body portion having a first end proximate the tool head portion, an opposing second end, and a receiving structure adjacent the second end; providing a self-securing handle including an elongate body having a first end and a second end, the elongate body having a central cavity passing therethrough from the first end to the second end, and a securing mechanism proximate the second end thereof; and inserting the tool main body portion into the first end of the self-securing handle so that the securing mechanism mates with the receiving structure to secure the handle to the tool main body portion.

According to a preferred method of the present invention, a stopping member is provided proximate the first end of the tool main body portion for preventing axial movement of the handle along the tool main body portion in a direction toward the first end of the handle. More preferably, a stepped portion on an outer surface of the tool main body portion and a corresponding stepped portion on an inner surface of the central cavity define the stopping member.

BRIEF DESCRIPTION OF THE DRAWINGS

For a fuller understanding of the nature and objects of the invention, reference should be made to the following detailed description of a preferred mode of practicing the invention, read in conjunction with the accompanying drawings, in which.

DETAILED DESCRIPTION OF THE INVENTION

Figure 1:
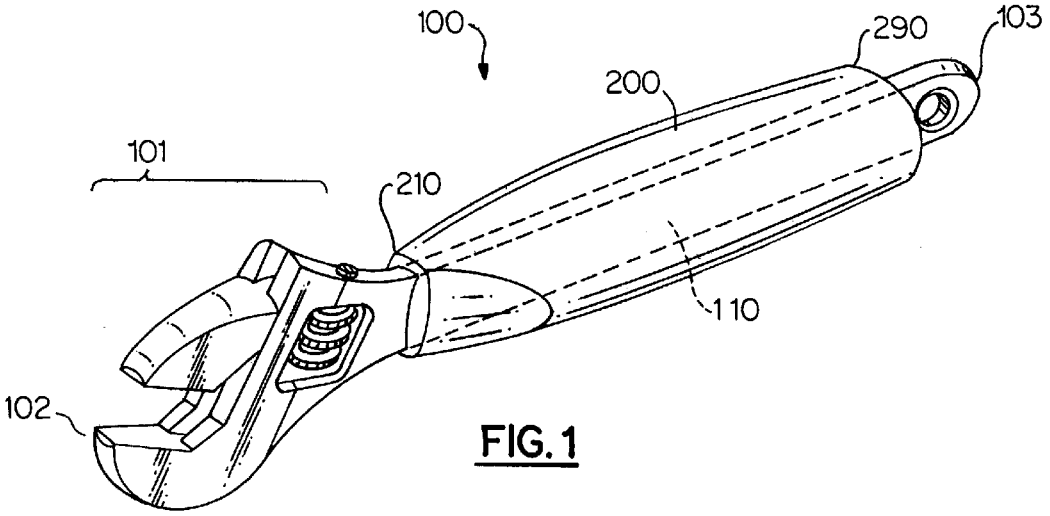
FIG. 1 is a perspective view of a tool having a self-securing handle in accordance with one embodiment of the invention.

FIG. 1 is a perspective view of a tool 100 having a self-securing handle 200 in accordance with one embodiment of the invention. The tool includes a first end 102 and an opposed second end 103. The tool further includes a tool head portion 101 proximate the first end 102 for gripping, torquing, or otherwise engaging a separate member. The tool also includes a main body portion 110 extending longitudinally from the tool head portion 101, toward the second end 103, and the tool main body portion 110 is substantially covered by the self-securing handle 200 upon assembly.

Figure 2:
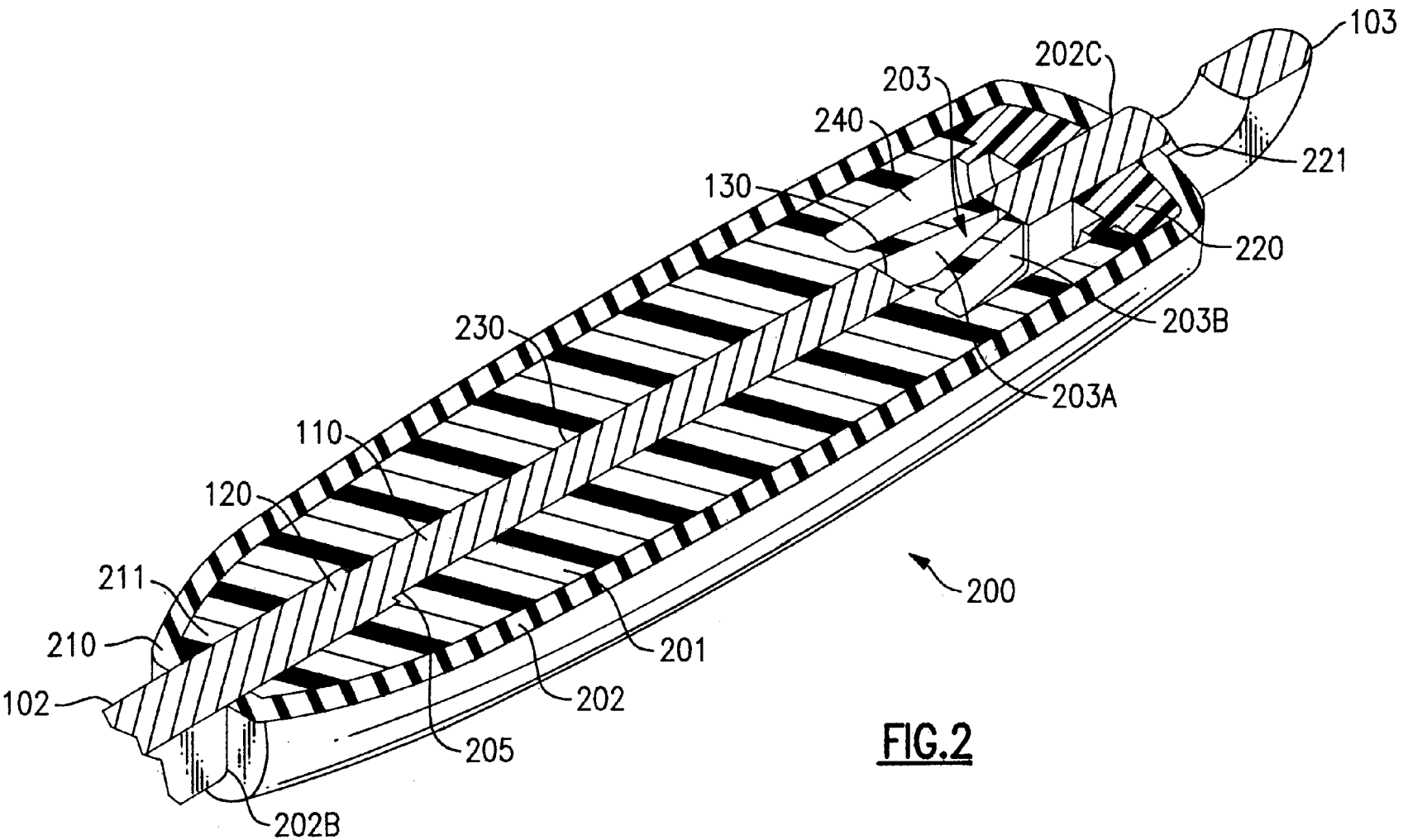
FIG. 2 is a longitudinal cross-sectional perspective view of the tool and handle as shown in FIG. 1.

FIG. 2 is a longitudinal cross-sectional perspective view of the assembled tool 100 and self-securing handle 200 as shown in FIG. 1. The self-securing handle 200 includes a first end 210 and an opposed second end 290. The self-securing handle 200 further includes an inner core body 201 having a first end 211 proximate the first end 210 of the handle 200, and a second end 212 proximate the second end 290 of the self-securing handle 200. The inner core body 201 includes a central cavity 230 extending longitudinally from the first end 211 to the second end 212 thereof, substantially passing through the inner core body 201.

The inner core body 201 further includes a stopping member 205 positioned within the central cavity 230 proximate the first end 211. The inner core body 201 also includes an open cavity 240 positioned proximate the second end 212 near the second end 290 of the self-securing handle 200. The inner core body further includes a securing mechanism 203 proximate the open cavity 240, having securing tabs 203A and 203B positioned within the central cavity 240 on opposite sides thereof. The securing tabs 203A and 203B extend radially into the central cavity 230 (open cavity 240) and axially toward the second end 212 of the inner core body 201.

The self-securing handle 200 also includes an end cap 220 proximate the second end 290 thereof, opposing the securing mechanism 203. The end cap 220 is typically press fit into the open cavity 240 to substantially enclose the securing mechanism 203 within the central cavity 230 (open cavity 240) of the inner core body 201.

The self-securing handle 200 further includes an external layer 202 extending longitudinally from the first end 210 to the second end 290, substantially covering an outer surface of the inner core body 201 providing continuous intimate contact therewith.

It is desirable that the inner core 201 be a rigid material to provide shape and mechanical strength and support for the self-securing handle portion 200, while the external layer 202 is preferably made of a soft, slightly deformable material to aid gripping and provide the desired tactile feel. SANTOPRENE (a flexible elastomeric material) is a preferred material for the external layer 202, more preferably SANTOPRENE (a flexible elastomeric material) having the shore A range of 40–65. Shore ranges outside the preferred ranges produce undesirable characteristics. That is, shore values above the preferred ranges represent a material which is harder than preferred, and shore values below the preferred range represent a material which is too soft and tacky. Although it is desirable that the inner core 201 is rigid, it is also desirable that the material is sufficiently elastic to properly perform upon molding and for receiving the tool main body portion 110 to engage both the securing mechanism 203 and the stop member 205.

The inner core 201 and the external layer 202 are substantially chemically bonded at the interface. Further, it is preferred that the tool main body portion 110 is embedded within, or substantially surrounded by, the inner core 201 of the self-securing handle 200, such that the tool main body portion 110 is not in direct contact with the external layer 202. This is desired because the self-securing handle portion 200 could move independently of the tool main body portion 110 upon the application of force since the external layer 202 and the main body portion 102 do not share a chemically bonded interface.

As shown in FIG. 2, the tool main body portion 110, having a first end 102 proximate the tool head portion 101 and the first end 210 of the self-securing handle 200, and an opposed second end 103 proximate the second end 290 of the self-securing handle 200 as shown in FIG. 1, is positioned within the central cavity 230 of the inner core body 201.

The tool main body portion 110 also includes a stepped portion 120 located on an outer surface of the tool main body portion 110 proximate the first end 102 thereof. The stepped portion 120 corresponds to the location of the stopping member 205 within the central cavity 230 of the inner core body 201, such that the stopping member 205 engages the corresponding stepped portion 120 upon assembly as shown. The stopping member 205 and corresponding stepped portion 120 are provided preventing axial movement of the self-securing handle 200 along the tool main body portion 110 in a direction toward the first end 210 of the self-securing handle 200.

The tool main body portion 101 further includes a receiving member 130 proximate the second end 103 thereof. The receiving member 130 corresponds to the location of the securing mechanism 203 within the central cavity 230 (open cavity 240) of the inner core body 201 proximate the second end 212, such that the securing mechanism 203 engages the receiving member 130 upon assembly as shown. The securing mechanism 203 of the inner core body 201 and the corresponding receiving member 130 of the tool main body portion 110 engage upon assembly to fasten the self-securing handle 200 over the tool main body portion 110. The joining achieved by the inter-locking components 203 and 130 eliminates the need to incorporate an additional adhesive step in the manufacture process.

Figure 3A:
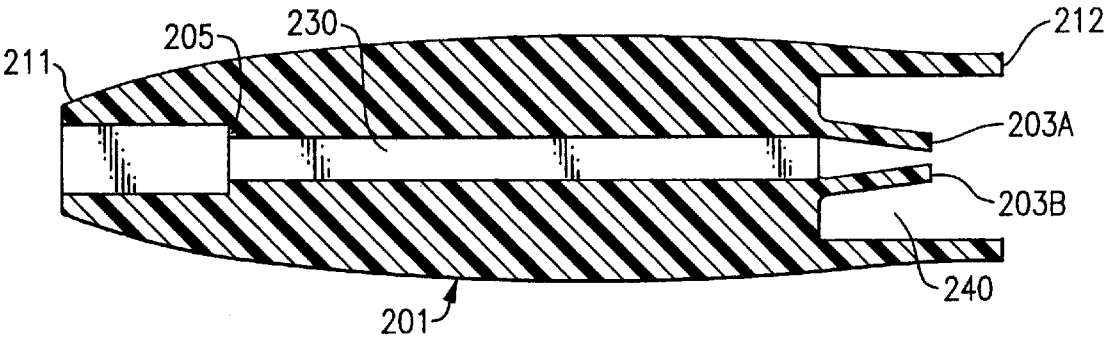
FIG. 3A is a cross-sectional view of the molded inner core body according to one embodiment of the invention, representing a step of an embodiment of the assembly method of the invention.

FIG. 3A is a cross-sectional view of a molded inner core body 201 according to one embodiment of the invention, representing a step of an embodiment of the assembly method of the invention. The inner core body 201 includes a central cavity 230 extending longitudinally from a first end 211 toward an opposed second end 212. The inner core body 210 also includes stopping member 205 is positioned within the central cavity 230 proximate the first end 211. The inner core body 210 further includes an open cavity 240 proximate the second end 212. A securing mechanism 203 is positioned within the central cavity 230 proximate the open cavity 240. The securing mechanism includes securing tabs 203A and 203B extending radially into the central cavity 230 (open cavity 240) and longitudinally toward the second end 212. The inner core body 201 can be molded as an integral unit comprising each of the above mentioned components.

Figure 3B:
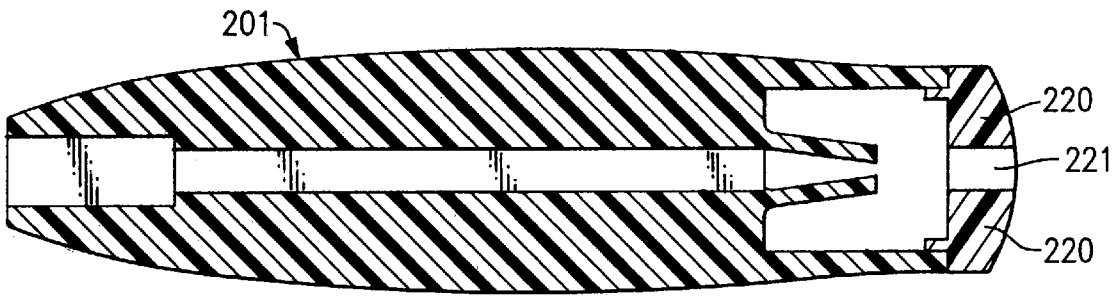
FIG. 3B is a cross-sectional view of the molded inner core body including an additional end-cap portion according to one embodiment of the present invention, representing an additional step of an embodiment of the assembly method of the invention.

FIG. 3B is a cross-sectional view of the molded inner core body 201 as shown in FIG. 3A, including an additional end-cap portion 220 according to one embodiment of the present invention, representing an additional step of an embodiment of the assembly method of the invention. The end cap portion 220 includes a main cavity 221 corresponding to the position of the central cavity 230 of the inner core body 201. The end cap portion 220 is typically molded as a separate component apart from the inner core body 201, although the end cap portion 220 may be made from the same material as the inner core body 201. After the separate molding step, the end cap portion 220 is mechanically fit into the open cavity 240 proximate the second end 212 of the inner core body 201.

Figure 3C:
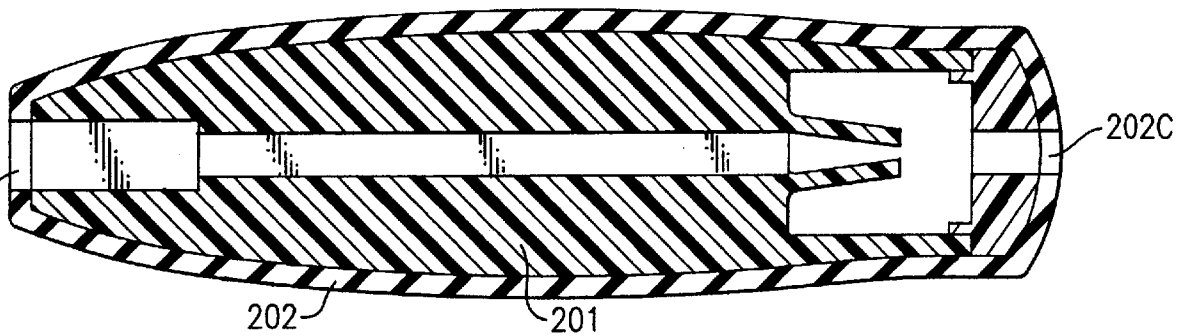
FIG. 3C is a cross-sectional view of the molded inner core body having an end-cap portion press-fit therewith, showing the over-molded external layer in accordance with an embodiment of the invention, representing yet another step of an embodiment of the assembly method of the invention.

FIG. 3C is a cross-sectional view of the molded inner core body 201 having an end-cap portion 220 press-fit therewith, further showing the over-molded external layer 202 in accordance with an embodiment of the invention, representing yet another step of an embodiment of the assembly method of the invention. The external layer 202 substantially covers an outer surface of the inner core body 201, providing intimate contact therewith. The external layer 202 includes a first opening 202B proximate the first end 211 of the inner core body 201 and corresponding to the position of the central cavity 230 thereof. The external layer 202 further includes a second opening 202C proximate the second end 212 of the inner core body 201 and corresponding to the position of the central cavity 230 thereof.

The external layer 202 is typically over-molded onto the inner core body 201. Since the inner core body 201 represents a discrete unit, the entire outer surface of which substantially contacts the external layer 202, the inner core body 201 can be easily inserted into a standardized mold for over-molding. This eliminates the flashing problems frequently associated with over-molding directly onto tools which extend from the mold in one or more directions.

Figure 4:
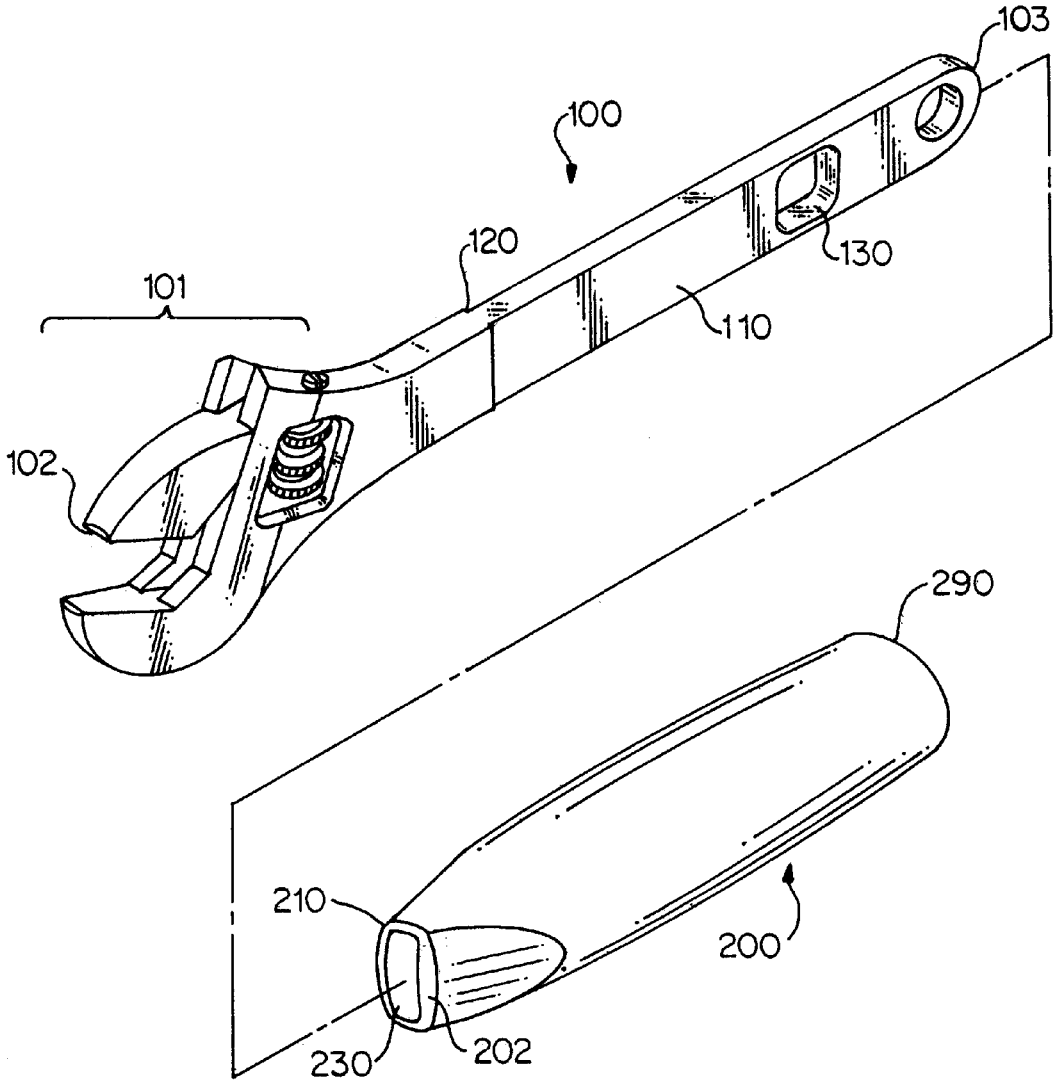
FIG. 4 is a perspective view showing the assembly of a forged wrench and a separately formed self-securing handle according to the present invention.

FIG. 4 is a perspective view showing the assembly of a forged wrench and a separately formed self-securing handle according to the present invention. The wrench includes a tool head portion 101 proximate a first end 102, and an elongate main body portion 110 extending longitudinally therefrom toward an opposed second end 103. The main body portion 110 further includes a stepped potion 120 proximate the first end 102, and a receiving member 130 proximate the second end 103.

The self-securing handle 200 includes an elongate body extending longitudinally from a first end 210 toward an opposed second end 290, having a central cavity 230 positioned therein. The self-securing handle also includes a stopping member (not shown) located within the central cavity 230 proximate the first end 210 and a securing mechanism (not shown) located within the central cavity 230 proximate the second end 290. Reference should be made to FIG. 3A, 3B and 3C for the specific details of the handle 200 not shown in Assembly of the wrench of FIG. 4 and the self-securing handle is accomplished by inserting the second end 103 of the main body portion 110 into the central cavity 230 of the self-securing handle proximate the first end 210 thereof. The securing mechanism (not shown) within the central cavity 230 proximate the second end 290 engages the receiving member 130 upon contact therewith to secure the handle 200 onto the main body portion 110. Furthermore, the stopping member (not shown) within the central cavity 230 engages the corresponding stepped portion 120 of the main body portion 110 proximate the first end 210 to prevent axial movement of the mechanically attached self-securing handle 200 along the main body portion 110 in a direction of the second end 290.

While the present invention has been particularly shown and described with reference to the preferred mode as illustrated in the drawings, it will be understood by one skilled in the art that various changes may be effected therein without departing from the spirit and the scope of the invention as defined by the claims.

We claim:

1. A self-securing handle for a tool having a longitudinally extending main body portion, said handle comprising:

an elongate body having a first end and a second end, and having a central cavity passing therethrough from said first end to said second end, said elongate body comprising an inner core body and an external layer, said inner core body having an inner surface which opposes the tool main body portion and an outer surface, wherein said inner core body extends longitudinally from said first end toward said second end, and wherein said central cavity of said handle passes through said inner core body from said first end to said second end, said external layer extending longitudinally from said first end toward said second end, said external layer substantially covering said outer surface of said inner core body; and a securing mechanism within said elongate body proximate said second end, wherein said handle receives the tool main body portion within said central cavity, and wherein said securing mechanism mates with a receiving structure on the tool main body portion to secure the handle to the tool main body portion, said inner core body further comprising an open cavity proximate said second end in substantial coaxial alignment with said central cavity, said securing mechanism being positioned within said open cavity.

2. The self-securing handle of claim 1, further comprising a stopping member positioned proximate said first end of said elongate body for preventing axial movement of said handle along the tool main body portion in a direction toward said first end of said handle.

3. The self-securing handle of claim 2, wherein said stopping member is located within said central cavity of said elongate body.

4. The self-securing handle of claim 1, wherein said securing mechanism comprises at least one securing tab extending axially toward said second end of said handle.

5. The self-securing handle of claim 4, wherein said at least one securing tab also extends radially into said central cavity.

6. The self-securing handle of claim 1, wherein said securing mechanism comprises two securing tabs positioned within said central cavity on opposite sides thereof, and wherein said tabs extend axially toward said second end of said handle.

7. The self-securing handle of claim 6, wherein said securing tabs also extend radially into said central cavity.

8. The self-securing handle of claim 1, wherein said external layer is over-molded onto said inner core body.

9. The self-securing handle of claim 1, wherein said securing mechanism is formed as an integral part of said inner core body.

10. The self-securing handle of claim 1, further comprising an end cap for engaging said second end of said inner core body, wherein said central cavity of said handle passes through said end cap.

11. The handle of claim 1, wherein said inner core body comprises a hard grade elastomer material.

12. The handle of claim 1, wherein said inner core body comprises a polypropylene material.

13. The handle of claim 1, wherein said external layer comprises a flexible grade elastomeric material.

14. The handle of claim 1, wherein said external layer comprises SANTOPRENE.

15. The handle of claim 10, wherein said end cap comprises a hard grade elastomeric material.

16. The handle of claim 10, wherein said end cap comprises a polypropylene material.

17. A tool including a self-securing handle, comprising:

a tool head portion;

a tool main body portion having a tool first end connected to said tool head portion and an opposed tool second end, said tool main body portion extending longitudinally from said tool first end toward said tool second end, and further comprising a receiving structure adjacent said tool second end thereof; and a self-securing handle comprising an elongate body and a securing mechanism, said elongate body having a handle first end and a handle second end, said elongate body having a central cavity passing therethrough from said handle first end to said handle second end, said securing mechanism being within said elongate body proximate said handle second end;

said elongate body comprising an inner core body and an external layer, said inner core body having a core body first end proximate said handle first end, and a core body second end proximate said handle second end, said inner core body having an outer surface and an inner surface which opposes said tool main body portion, wherein said inner core body extends longitudinally from said core body first end toward said core body second end, and wherein said central cavity of said handle passes through said inner core body from said core body first end to said core body second end, said external layer extending longitudinally from said handle first end toward said handle second end, said external layer substantially covering said outer surface of said inner core body, said tool main body portion being positioned within said central cavity such that said securing mechanism mates with said receiving structure to secure said handle to said tool main body portion, said inner core body further comprising an open cavity proximate said core body second end in substantial coaxial alignment with said central cavity, said securing mechanism being positioned within said open cavity.

18. The tool of claim 17, wherein said securing mechanism comprises at least one securing tab extending axially toward said second end of said handle.

19. The tool of claim 18, wherein said at least one securing tab also extends radially into said central cavity.

20. The tool of claim 17, further comprising a stopping member proximate said first end of said tool main body portion for preventing axial movement of said handle along said tool main body portion in a direction toward said first end of said handle.

21. The tool of claim 20, wherein said stopping member is located within said central cavity of said elongate body.

22. The tool of claim 20, wherein said stopping member comprises a stepped portion on an outer surface of said tool main body portion and a corresponding stepped portion on an inner surface of said central cavity.

23. The tool of claim 17, wherein said securing mechanism comprises two securing tabs positioned within said central cavity on opposite sides thereof, and wherein said tabs extend axially toward said second end of said handle.

24. The tool of claim 23, wherein said securing tabs also extend radially into said central cavity.

25. The tool of claim 17, wherein said external layer is over-molded onto said inner core body.

26. The tool of claim 17, wherein the cross-sectional shape of said tool main body portion substantially corresponds to the cross-sectional shape of said central cavity, and wherein said cross-sectional shape is substantially non-circular to prevent rotation of said handle about the longitudinal axis of said tool main body portion.

27. The tool of claim 17, wherein said securing mechanism is formed as an integral part of said inner core body.

28. The tool of claim 17, further comprising an end cap for engaging said second end of said inner core body, wherein said central cavity of said handle passes through said end cap.

29. The tool of claim 17, wherein said inner core body of said self-securing handle comprises a hard grade elastomeric material.

30. The tool of claim 17, wherein said inner core body of said self-securing handle comprises a polypropylene material.

31. The tool of claim 17, wherein said external layer of said self-securing handle comprises a flexible grade elastomeric material.

32. The tool of claim 17, wherein said external layer comprises SANTOPRENE.

33. The tool of claim 28, wherein said end cap comprises a hard grade elastomeric material.

34. The tool of claim 28, wherein said end cap comprises a polypropylene material.

35. The self-securing handle of claim 1, further comprising a stopping member for limiting axial movement of said handle relative to a tool main body portion, said central cavity having an outer wall within which said tool main body portion is to be received, said stopping member comprising a stepped portion in said outer wall of said cavity at an intermediate position along an axial length of said outer wall.

36. A self-securing handle for a tool having a longitudinally extending main body portion, said handle comprising:

an elongate body having a first end and a second end, and having a central cavity passing therethrough from said first end to said second end; and a securing mechanism within said elongate body proximate said second end, wherein said handle receives the tool main body portion within said central cavity, and wherein said securing mechanism mates with a receiving structure on the tool main body portion to secure the handle to the tool main body portion, said securing mechanism comprising at least one securing tab having an attached end and a cantilevered end, said attached end being attached to said elongate body, said cantilevered end being free to move relative to said elongate body, said cantilevered end being spaced axially from said attached end toward said second end and said cantilevered end being spaced radially from said attached end into said central cavity.

37. The self-securing handle of claim 36, further comprising a stopping member for limiting axial movement of said handle relative to a tool main body portion, said central cavity having an outer wall within which said tool main body portion is to be received, said stopping member comprising a stepped portion in said outer wall of said cavity at an intermediate position along an axial length of said outer wall.

38. The self-securing handle of claim 36, wherein said elongate body comprises an open cavity proximate said second end in substantial coaxial alignment with said central cavity, said cantilevered end of said securing tab being positioned within said open cavity.

39. A tool including a self-securing handle, comprising:

a tool head portion;

a tool main body portion having a tool first end connected to said tool head portion and an opposed tool second end, said tool main body portion extending longitudinally from said tool first end toward said tool second end, and further comprising a receiving structure adjacent said tool second end thereof; and a self-securing handle comprising an elongate body and a securing mechanism, said elongate body having a handle first end and a handle second end, said elongate body having a central cavity passing therethrough from said handle first end to said handle second end, said securing mechanism being within said elongate body proximate said handle second end;

said tool main body portion being positioned within said central cavity;

said securing mechanism comprising at least one securing tab having an attached end and a cantilevered end, said attached end being attached to said elongate body, said cantilevered end being free to move relative to said elongate body, said cantilevered end being spaced axially from said attached end toward said handle second end and said cantilevered end being spaced radially from said attached end into said receiving structure to secure said handle to said tool main body portion.

40. The self-securing handle of claim 39, further comprising a stopping member for limiting axial movement of said handle relative to said tool main body portion, said central cavity having an outer wall within which said tool main body portion is received, said stopping member comprising a stepped portion in said outer wall of said cavity at an intermediate position along an axial length of said outer wall.

41. The self-securing handle of claim 39, wherein said elongate body comprises an open cavity proximate said handle second end in substantial coaxial alignment with said central cavity, said cantilevered end of said securing tab being positioned within said open cavity.

* * * * *